US012565770B2

(12) United States Patent
Sato et al.

(10) Patent No.: US 12,565,770 B2
(45) Date of Patent: Mar. 3, 2026

(54) DIAGONAL BEAM JOINING HARDWARE AND BEAM CONNECTING STRUCTURE

(71) Applicant: SEKISUI HOUSE, LTD., Osaka (JP)

(72) Inventors: Ryosuke Sato, Osaka (JP); Daiki Fukumoto, Osaka (JP); Takeshi Ichihari, Osaka (JP); Yasuaki Takahashi, Osaka (JP); Dai Hashimoto, Osaka (JP); Satoru Takeuchi, Osaka (JP); Tatsuya Ishikawa, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 367 days.

(21) Appl. No.: 18/012,957

(22) PCT Filed: May 31, 2021

(86) PCT No.: PCT/JP2021/020643
§ 371 (c)(1),
(2) Date: Dec. 26, 2022

(87) PCT Pub. No.: WO2022/024542
PCT Pub. Date: Feb. 3, 2022

(65) Prior Publication Data

US 2023/0257988 A1 Aug. 17, 2023

(30) Foreign Application Priority Data

Jul. 30, 2020 (JP) ..... 2020-129645

(51) Int. Cl.
*E04B 1/26* (2006.01)
*E04B 1/10* (2006.01)
*E04B 1/38* (2006.01)

(52) U.S. Cl.
CPC ..... *E04B 1/2612* (2013.01); *E04B 1/10* (2013.01); *E04B 2001/2648* (2013.01); *E04B 2001/389* (2023.08)

(58) Field of Classification Search
CPC ..... E04B 1/10; E04B 1/2612; E04B 1/2604; E04B 1/58; E04B 2001/2644; E04B 2001/2648; E04B 2001/389
(Continued)

(56) References Cited

U.S. PATENT DOCUMENTS 2,629,906 A * 2/1953 Holmes ..... E04B 1/2604 403/187
2,889,176 A * 6/1959 Thompson ..... B25H 1/06 182/186.3
(Continued)

FOREIGN PATENT DOCUMENTS

JP H0524718 U * 3/1993
JP H10-25811 A 1/1998
(Continued)

*Primary Examiner* — James M Ference
(74) *Attorney, Agent, or Firm* — METROLEX IP LAW GROUP, PLLC; Robert L. Scott, Esq.

(57) ABSTRACT

Diagonal beam joining hardware according to one or more embodiments includes: a beam splicing part; an extending part protruding from an appropriate intermediate part of the beam splicing part; and a beam receiving hardware mounting part bending and extending from an end edge of the extending part to form a predetermined plane angle with respect to the beam splicing part. The beam splicing part is attached and fastened to a side face of a continued beam by through bolts and penetrating the beam in the beam width direction. Beam receiving hardware is fitted in a slit formed in an end part of the diagonal beam. A contacting part of the beam receiving hardware is superimposed on the beam
(Continued)

receiving hardware mounting part of the diagonal beam joining hardware and fastened by bolt/nut fastening.

3 Claims, 8 Drawing Sheets

(58) Field of Classification Search
USPC ..... 52/633, 702
See application file for complete search history.

(56) References Cited

U.S. PATENT DOCUMENTS 3,283,465 A * 11/1966 Cheskin ..... E04B 1/24 52/653.1
3,423,898 A * 1/1969 Coloney ..... E04B 7/063 D25/17
3,481,635 A * 12/1969 Tracy ..... F16B 9/058 403/3
3,596,941 A * 8/1971 Tracy ..... E04B 7/02 52/713
4,230,416 A * 10/1980 Gilb ..... F16B 9/052 248/300
4,261,155 A * 4/1981 Gilb ..... E04B 1/2612 248/282.1
4,423,977 A * 1/1984 Gilb ..... F16B 9/058 52/702
4,560,301 A * 12/1985 Gilb ..... F16B 9/058 403/3
4,616,950 A * 10/1986 Morris ..... E04B 1/2604 403/231
4,817,359 A * 4/1989 Colonias ..... F16B 9/058 52/643
5,061,111 A * 10/1991 Hosokawa ..... E04C 3/36 403/187
5,217,317 A * 6/1993 Young ..... F16B 9/052 403/14
5,220,766 A * 6/1993 Hills, Sr. ..... E04B 1/2608 403/403
5,230,198 A * 7/1993 Callies ..... F16B 9/058 52/696
5,240,342 A * 8/1993 Kresa, Jr. ..... F16B 9/058 403/403
5,242,239 A * 9/1993 Hosokawa ..... E04B 1/2604 403/258
5,253,945 A * 10/1993 Hosokawa ..... E04C 3/38 403/258
5,284,311 A * 2/1994 Baer ..... A47B 57/402 403/381
5,341,619 A * 8/1994 Dunagan ..... F16B 9/052 248/300
5,342,138 A * 8/1994 Saito ..... E04H 12/2261 403/189
5,438,811 A * 8/1995 Goya ..... F16B 9/058 52/704
5,577,856 A * 11/1996 Tezuka ..... E04B 1/2604 403/294
5,598,680 A * 2/1997 Wilhelmi ..... E04B 1/2608 403/231
5,797,694 A * 8/1998 Breivik ..... E04B 7/06 403/231
5,896,721 A * 4/1999 Sugiyama ..... F16B 9/058 52/712
5,921,049 A * 7/1999 Sugiyama ..... F16B 9/058 52/656.1
5,941,044 A * 8/1999 Sera ..... E04B 1/2604 52/651.07
6,607,086 B1 * 8/2003 Gretz ..... E04B 9/006 248/343
6,669,396 B2 * 12/2003 Mattle ..... F16B 25/10 403/294
8,511,033 B2 * 8/2013 Kumakawa ..... F16B 9/058 52/655.1
9,920,531 B1 * 3/2018 Charest ..... E04C 3/12
10,370,842 B2 * 8/2019 Wesney ..... E04B 1/2612
11,525,255 B2 * 12/2022 Brekke ..... E04B 1/2612
2007/0044420 A1 * 3/2007 Lin ..... E04B 7/063 52/696
2014/0157716 A1 * 6/2014 Sidhu ..... E04B 7/022 52/696
2014/0318073 A1 * 10/2014 Sidhu ..... E04B 5/12 52/702
2014/0338282 A1 * 11/2014 Sidhu ..... E04C 3/14 52/702
2017/0175381 A1 * 6/2017 Wesney ..... E04B 1/388
2022/0307255 A1 * 9/2022 Takahashi ..... E04B 1/2612
2023/0257988 A1 * 8/2023 Sato ..... E04B 1/2604 52/633

FOREIGN PATENT DOCUMENTS

JP H10-25812 A 1/1998
JP 2000-104339 A 4/2000
JP 2002-242316 A 8/2002
JP 2004-68444 A 3/2004
JP 2004-218325 A 8/2004
JP 2005-163325 A 6/2005
JP 2006-328646 A 12/2006
SE 465522 B * 9/1991 ..... E04B 1/58

* cited by examiner

DIAGONAL BEAM JOINING HARDWARE AND BEAM CONNECTING STRUCTURE

TECHNICAL FIELD

The invention of the present disclosure relates to diagonal beam joining hardware diagonally joining beams of a wooden building and also to a beam connecting structure using the joining hardware.

BACKGROUND ART

In the framework of a wooden building, various kinds of shapes of joining hardware are used for a T-shaped/diagonal joint or a straight joint of members, in order to efficiently construct the building or to improve aseismic performance. Among them, beam receiving hardware disclosed, for example, in Patent Document 1 is known, which is joining hardware made of a bent steel sheet substantially having an angular-U shape in plan view, and which is used in particular when an end part of one beam is struck and connected to a side face of another beam or pillar. The Applicant of the present disclosure has also proposed, as disclosed in Patent Documents 2 to 5 and the like, improved versions of the beam receiving hardware and a beam connecting structure using the beam receiving hardware.

FIG. 1 is a diagram illustrating a connecting structure in which two beams 2 and 3 are connected so as to orthogonally intersect with each other using conventional beam receiving hardware 1. The beam receiving hardware 1 includes: a rectangular-shaped contacting part 12 that comes into contact with the side face of the continued beam 2; and a pair of inserting parts 13 that is bent at a right angle from both edge parts of the contacting part 12 and protrudes toward the discontinued beam 3 so as to be parallel to each other. A bottom part (not shown) is provided to connect between both lower end edges of the pair of inserting parts 13. Through bolts 42, which are to penetrate the continued beam 2 in the beam width direction, are inserted into a plurality of through holes (not shown) formed in the contacting part 12 so that the contacting part 12 is fastened to the side face of the beam 2. Furthermore, the inserting parts 13 are inserted into slits 31 formed in an end part of the discontinued beam 3 while a through bolt 43 and drift pins 44, which are to penetrate the discontinued beam 3 in the beam width direction, are inserted into a bolt receiving part 14 and a plurality of through holes 15 formed in the inserting part 13. Thus, the contacting part 12 is also connected to the beam 3.

PRIOR ART DOCUMENTS

Patent Documents

[Patent Document 1] JP 2000-104339 A
[Patent Document 2] JP H10-025811 A
[Patent Document 3] JP H10-025812 A
[Patent Document 4] JP 2005-163325 A
[Patent Document 5] JP 2006-328646 A

SUMMARY OF THE INVENTION

Problem to Be Solved by the Invention

As exemplarily shown in FIG. 8A, FIG. 8B and FIG. 8C, there are attempts to provide an atrium 91 inside a house 9 and also to provide an overhanging floor 93 having a triangular shape in plan view at a corner of an upper floor surface 92 facing the atrium 91, for the purpose of creating a unique space around the atrium 91 or giving variety to movement lanes surrounding the atrium 91. In the case where such a space is realized in the wooden framework, it is required to provide, in the horizontal diaphragm surrounding the atrium 91, a diagonal beam at an inner corner made by two beams orthogonally connected to each other such that the diagonal beam obliquely intersects with the two beams in plan view. In this way, the triangular-shaped overhanging floor 93 is supported by the diagonal beam.

However, the conventional beam receiving hardware as described above is only available to a part where the beams intersect orthogonally with each other. Thus, an object of the invention of the present disclosure is to provide diagonal beam joining hardware suitable for obliquely connecting the beams together with the conventional beam receiving hardware, and furthermore a beam connecting structure using the diagonal beam joining hardware.

In the invention of the present disclosure, any general horizontal structural members that are substantially horizontally bridged in the framework of the wooden building to support the horizontal diaphragm are collectively called as "beams".

Means for Solving the Problem

In order to achieve the above object, diagonal beam joining hardware of the invention of the present disclosure has an elemental configuration to join a beam to a diagonal beam that obliquely intersects with the beam in plan view such that the beam is a continued beam with respect to the diagonal beam. The diagonal beam joining hardware includes: a beam splicing part to be attached to a side face of the continued beam; an extending part protruding from an appropriate intermediate part of the beam splicing part in a width direction of the beam splicing part so as to make a T-shape together with the beam splicing part in plan view; and a beam receiving hardware mounting part bending and extending from an end edge of the extending part so as to form a predetermined plane angle with respect to the beam splicing part. A plurality of through holes is formed in the beam splicing part, respectively on both sides with respect to the extending part. A coupling member to be connected to beam receiving hardware that is attached to an end part of the diagonal beam is disposed in the beam receiving hardware mounting part.

Furthermore, in the above-described diagonal beam joining hardware, an additional configuration may be adopted, in which the coupling member disposed in the beam receiving hardware mounting part is constituted of a plurality of through holes.

Furthermore, in the above-described diagonal beam joining hardware, an additional configuration may be adopted, in which a reinforcing rib is fitted in an inner part surrounded by the beam splicing part, the extending part and the beam receiving hardware mounting part.

Furthermore, in the above-described diagonal beam joining hardware, an additional configuration may be adopted, in which the plurality of through holes formed in the beam splicing part is respectively long holes each have a long axis in the width direction of the beam splicing part.

Also, a beam connecting structure of the invention of the present disclosure has an elemental configuration to join at least one beam to a diagonal beam that obliquely intersects with the at least one beam in plan view using the above-described diagonal beam joining hardware such that the at least one beam is a continued beam with respect to the diagonal beam. The beam splicing part of the diagonal beam joining hardware is attached and fastened to a side face of the at least one beam by a through bolt that penetrates the at least one beam in a beam width direction. Beam receiving hardware is fitted in a slit formed in an end part of the diagonal beam. The beam receiving hardware includes: a contacting part having a shape of a vertically elongated rectangle; and a pair of inserting parts bending and protruding from both edge parts of the contacting part at a right angle so as to be parallel to each other. The contacting part of the beam receiving hardware is superimposed on the beam receiving hardware mounting part of the diagonal beam joining hardware so as to be fastened by bolt/nut fastening.

Furthermore, in the above-described beam connecting structure, an additional configuration may be adopted, in which the diagonal beam is bridged at an inner corner made by two beams orthogonally connected to each other such that the diagonal beam intersects with the two beams respectively at 45 degrees in plan view, and in which each end part of the diagonal beam is connected to a corresponding beam of the two beams by the beam receiving hardware and the diagonal beam joining hardware.

Furthermore, in the above-described beam connecting structure, an additional configuration may be adopted, in which: a plurality of diagonal beams is bridged at the inner corner made by the two beams orthogonally connected to each other such that the plurality of diagonal beams is parallel to one another; each end part of the plurality of diagonal beams is connected to a corresponding beam of the two beams by the beam receiving hardware and the diagonal beam joining hardware; a tie beam is provided between two corresponding diagonal beams of the plurality of diagonal beams such that the tie beam is orthogonal to the two corresponding diagonal beams in plan view; and each end part of the tie beam is connected to a corresponding side face of the two corresponding diagonal beams by the beam receiving hardware.

Effects of the Invention

By using the above-described diagonal beam joining hardware together with the publicly known beam receiving hardware, it is possible to join one beam (a diagonal beam) to a side face of another beam, by easy and reliable processes, such that they obliquely intersect with each other in plan view. Since the above-described diagonal beam joining hardware can be used together with the beam receiving hardware that has already been practically used, it is advantageous from the aspect of the cost. Furthermore, the connected part using the above two kinds of hardware together has a practically sufficient strength.

The diagonal beam joining hardware includes: a beam splicing part to be attached to the side face of another beam; an extending part protruding from an appropriate intermediate part of the beam splicing part in a direction orthogonally intersecting with the beam splicing part; and a beam receiving hardware mounting part bending and extending from an end edge of the extending part so as to form a predetermined plane angle with respect to the beam splicing part. Furthermore, a plurality of through holes, into which bolts or pins can be inserted, is formed in the beam splicing part, respectively on both sides with respect to the extending part. Thus, when the beam splicing part is fixed to the side face of another beam by bolts and nuts, or when the beam receiving hardware is fixed to the beam receiving hardware mounting part by bolts and nuts, it is possible to insert the bolt and fasten the nut easily. In addition, when the diagonal beam is connected to a joining part of the beam and the pillar or to an intersecting part of the beams having a T-shape or a cross shape in plan view, it is also possible to easily connect the diagonal beam to them by making the extension line of the axis of the diagonal beam pass through the corresponding connection center of the joining part or the intersecting part.

Also, by adopting the beam connecting structure in which the diagonal beam is bridged at an inner corner made by the two beams orthogonally connected to each other and in which each end part of the diagonal beam is connected to a corresponding beam of the two orthogonally intersecting beams by the beam receiving hardware and the diagonal beam joining hardware used together, it is possible to efficiently construct the floor framing, for example, with a floor surface that has a triangular shape in plan view and that overhangs from an inner corner of the horizontal diaphragm surrounding an atrium.

BRIEF DESCRIPTION OF THE INVENTION

MODE FOR CARRYING OUT THE INVENTION

Figure 1:
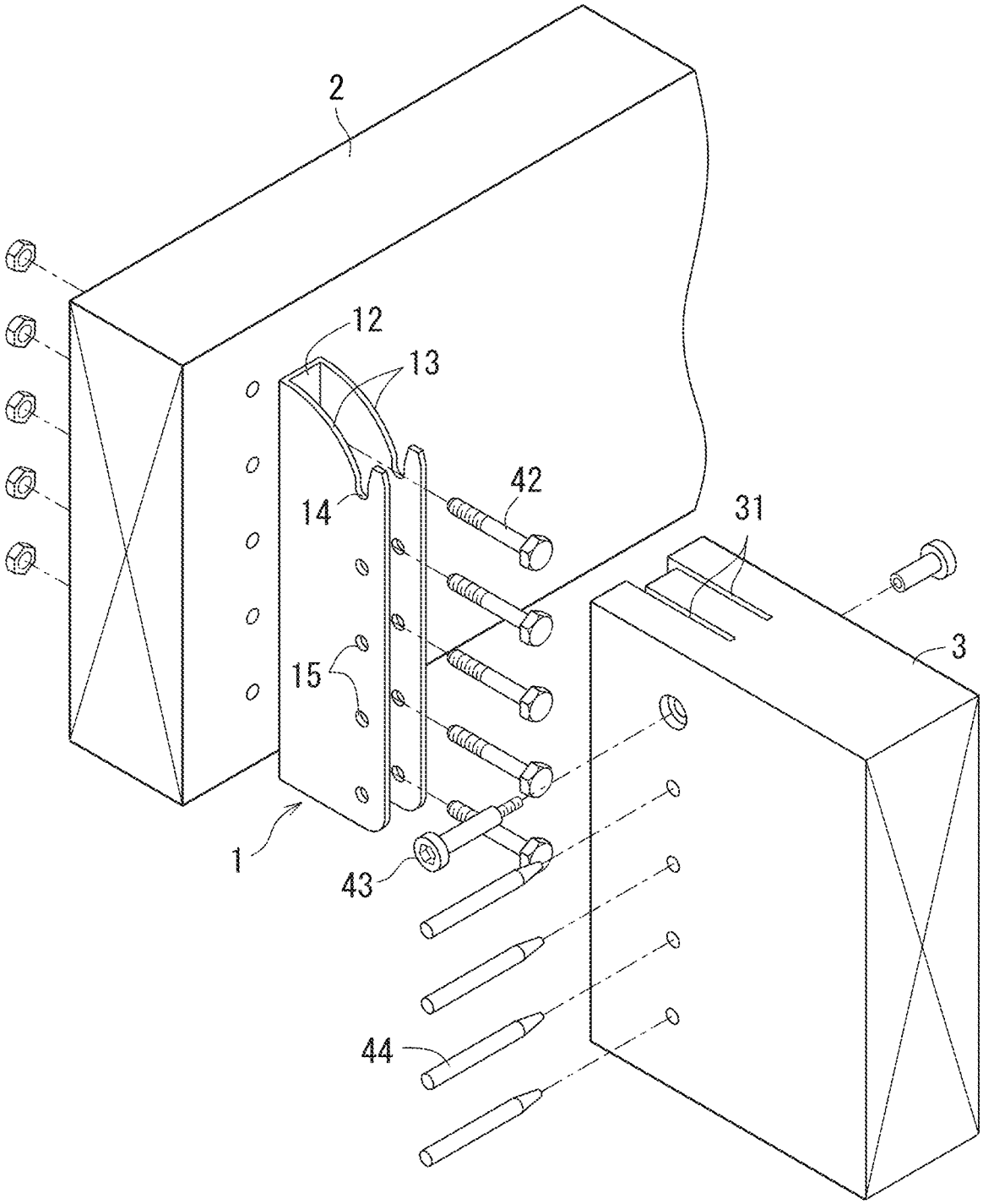
FIG.1 Prior Art
FIG. 1 is a perspective view illustrating a structure in which two beams are connected so as to orthogonally intersect with each other using conventional beam receiving hardware.

Hereinafter, embodiments of the invention of the present disclosure will be described with reference to the drawings. Since the conventional beam receiving hardware 1 shown in FIG. 1 is also used in the embodiments described below, the parts/members related to the beam receiving hardware 1 have the same reference numerals as those in FIG. 1, and the detail description thereof is omitted. Furthermore, when a plurality of embodiments is described, the same reference numerals are used to designate the characteristic elements whose functions and/or effects are substantially in common so as to simplify the explanation in the respective embodiments later by avoiding redundancy.

Figure 2:
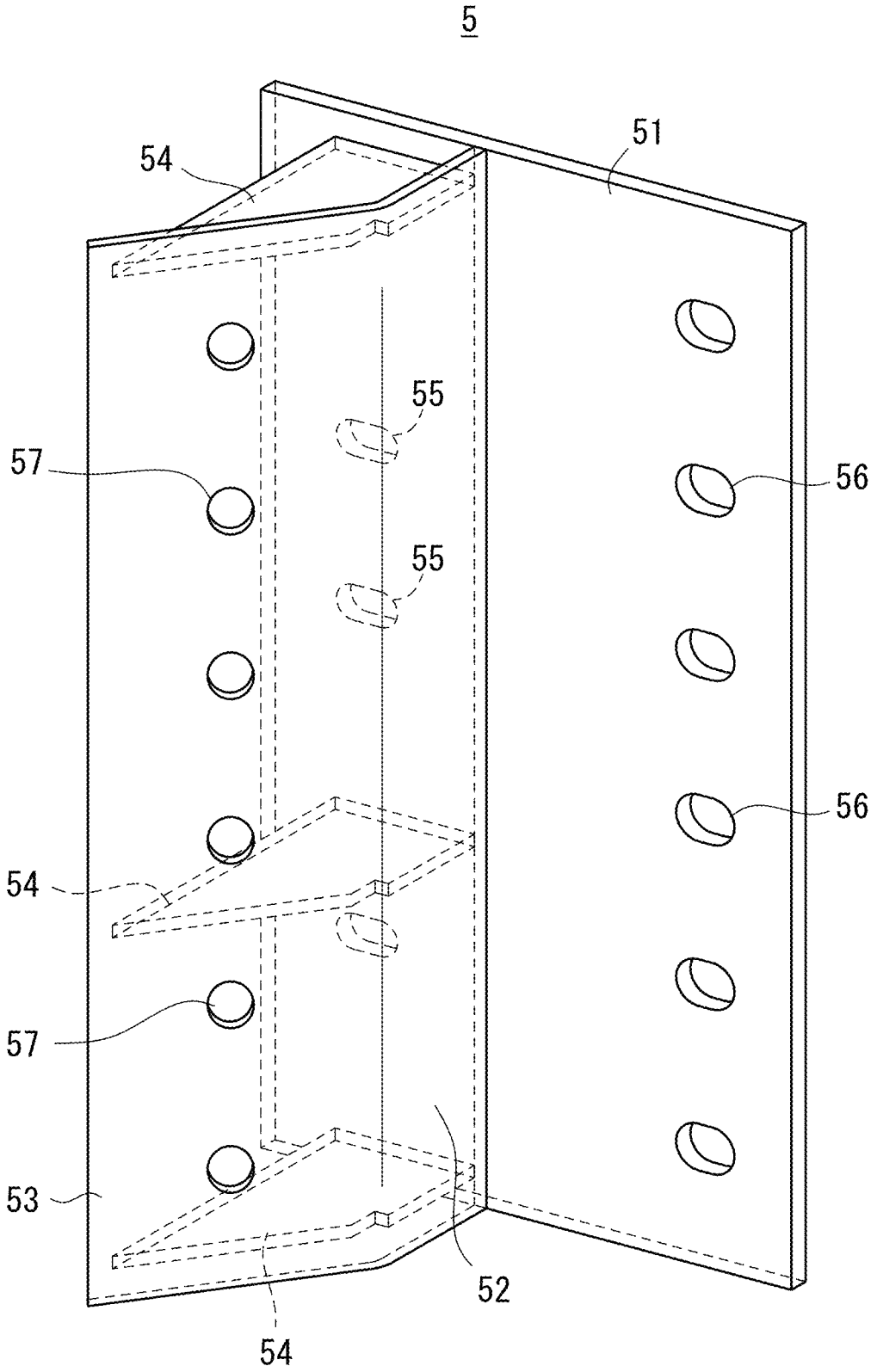
FIG. 2 is a perspective view illustrating diagonal beam joining hardware according to a first embodiment.
Figure 3:
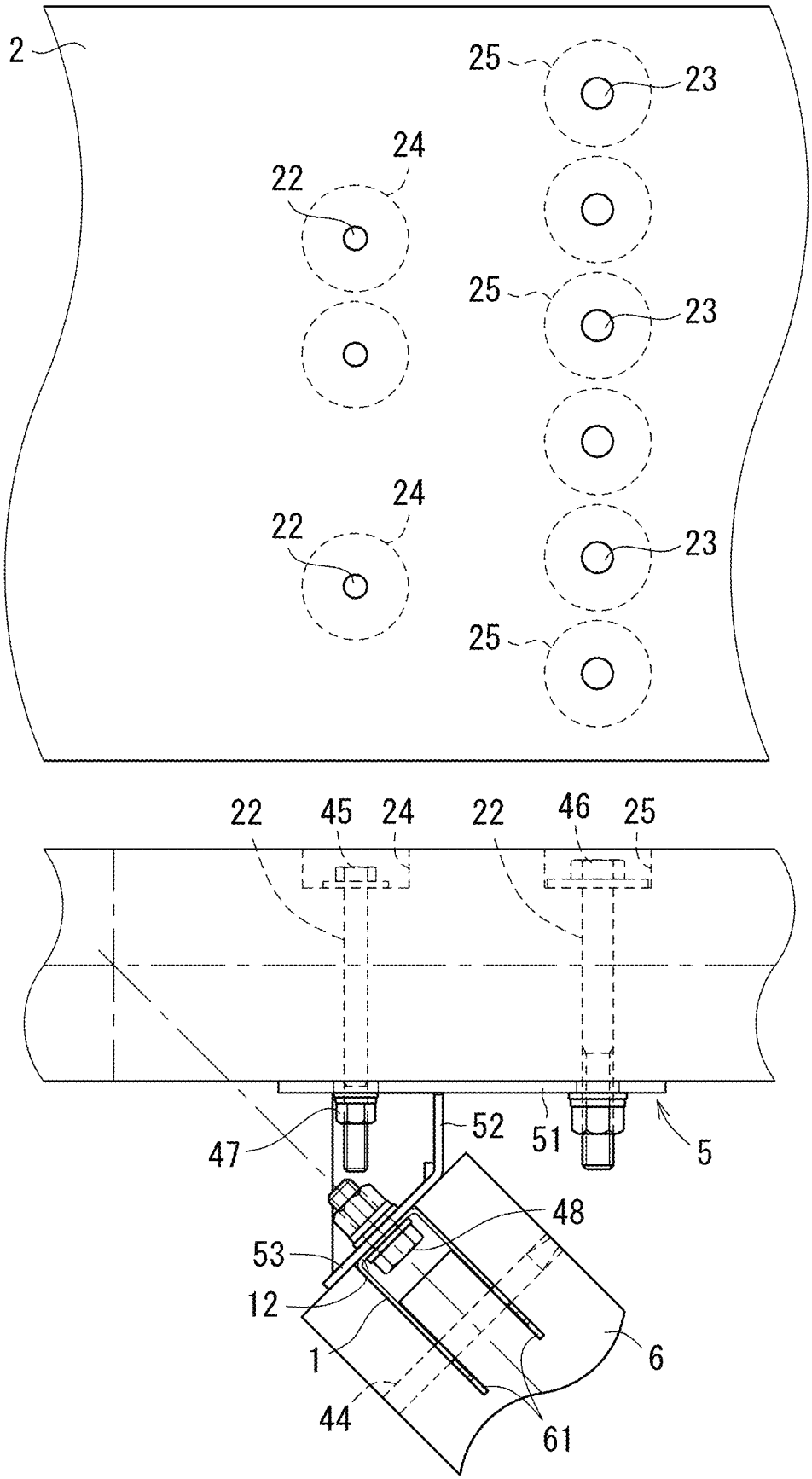
FIG. 3 is a set of diagrams illustrating: a front view enlargedly indicating a structure in which two beams are obliquely connected using diagonal beam joining hardware such as the diagonal beam joining hardware shown in FIG. 2; and a side view of a continued beam.

FIG. 2 shows diagonal beam joining hardware 5 according to a first embodiment of the invention of the present disclosure. FIG. 3 shows a structure in which two beams 2 and 6 are obliquely connected using the diagonal beam joining hardware 5 together with the conventional beam receiving hardware 1.

The diagonal beam joining hardware 5 is a member made by cutting, bending, welding etc. a steel sheet. The diagonal beam joining hardware 5 includes: a beam splicing part 51; an extending part 52 protruding up to a predetermined length from an appropriate intermediate part of the beam splicing part 51 in the width direction of the beam splicing part 51 so as to make a T-shape together with the beam splicing part 51 in plan view; beam receiving hardware mounting part 53 bending at and extending from an end edge of the extending part 52 so as to form a predetermined plane angle (in this example, 45 degrees) with respect to the beam splicing part 51; and a plurality of reinforcing ribs 54 that is orthogonally attached to the beam splicing part 51, the extending part 52 and the beam receiving hardware mounting part 53. The beam splicing part 51, the extending part 52 and the beam receiving hardware mounting part 53 respectively have shapes of vertically elongated rectangles having the same height when viewed from the direction perpendicular to a plane. The reinforcing ribs 54 each having a substantially trapezoidal shape are respectively attached to three parts, i.e. an upper part, a lower part and an intermediate part of an inner part surrounded by the beam splicing part 51, the extending part 52 and the beam receiving hardware mounting part 53.

A plurality of through holes 55 and a plurality of through holes 56 are formed and arranged in the beam splicing part 51 at appropriate intervals in the height direction, respectively on the left side and the right side with respect to the extending part 52. These through holes 55 and 56 are long holes each have a long axis in the width direction of the beam splicing part 51.

Also, a plurality of through holes 57 is formed and arranged in the beam receiving hardware mounting part 53 at appropriate intervals in the height direction. These through holes 57 are round holes, and are located so as to respectively coincide with the through holes (not shown) for through bolts formed in the contacting part 12 of the beam receiving hardware 1 that is used together with the diagonal beam joining hardware 5.

The diagonal beam joining hardware 5 is attached to a side face of the continued beam 2. The continued beam 2 is provided with: penetrating holes 22 and 23 formed in the beam width direction so as to be located and arranged to coincide with the through holes 55 and 56 that are formed in the beam splicing part 51 in advance; and spot facing parts 24 and 25 made by expanding the diameters of respective opening ends of the penetrating holes 22 and 23 in a side face opposite to the side face to which the diagonal beam joining hardware 5 is attached. Thus, the beam splicing part 51 attached to the side face of the beam 2 is fixed to the beam 2 by the through bolts 45 and 46 that penetrate the beam 2 in the beam width direction.

At this time, since the beam receiving hardware mounting part 53 is provided so as to have an appropriate distance between the beam splicing part 51 via the extending part 52 protruding from the beam splicing part 51, the beam receiving hardware mounting part 53 does not prevent a nut 47 from being threadably engaged with a tip end of the through bolt 45 that protrudes from the beam 2. Also, the tip end of the through bolt 45 can be inserted into the penetrating hole 22 of the beam 2 from the side of the beam receiving hardware mounting part 53.

Meanwhile, in an end part of the diagonal beam 6 that is the discontinued beam, two slits 61 are formed, to which the conventional type of beam receiving hardware 1 is attached. The contacting part 12 of the beam receiving hardware 1 is superimposed on the beam receiving hardware mounting part 53 of the diagonal beam joining hardware 5, and the binding bolts 48 are inserted into the respective through holes and fastened by the nuts. The binding bolt 48 may be welded to the contacting part 12 in advance so as to protrude in the direction opposite to the diagonal beam 6. Also, the end part of the diagonal beam 6 may be connected to the beam receiving hardware 1 after the diagonal beam joining hardware 5 and the beam receiving hardware 1 have been connected by the binding bolts 48.

Figure 4:
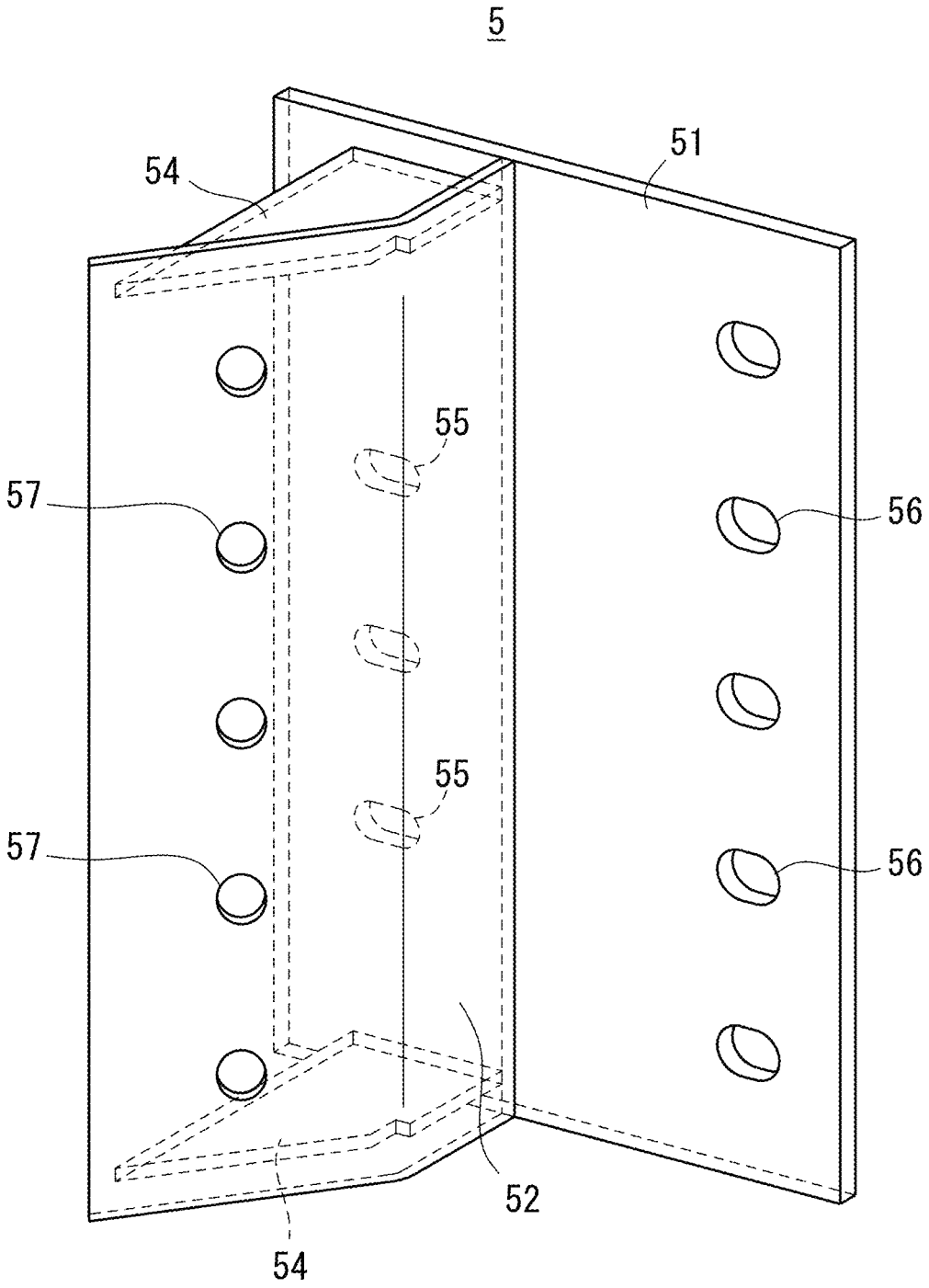
FIG. 4 is a perspective view illustrating diagonal beam joining hardware according to a second embodiment.

FIG. 4 shows the diagonal beam joining hardware 5 according to a second embodiment of the invention of the present disclosure. This diagonal beam joining hardware 5 is to be used to a connecting part having a relatively small beam depth. That is, the respective heights of the beam splicing part 51, the extending part 52 and the beam receiving hardware mounting part 53 are smaller than those in the first embodiment. According to this height reduction, the respective numbers of the through holes 55, 56 and 57 are also reduced, and the reinforcing ribs 54 are attached to only two parts, i.e. an upper part and a lower part.

Figure 5:
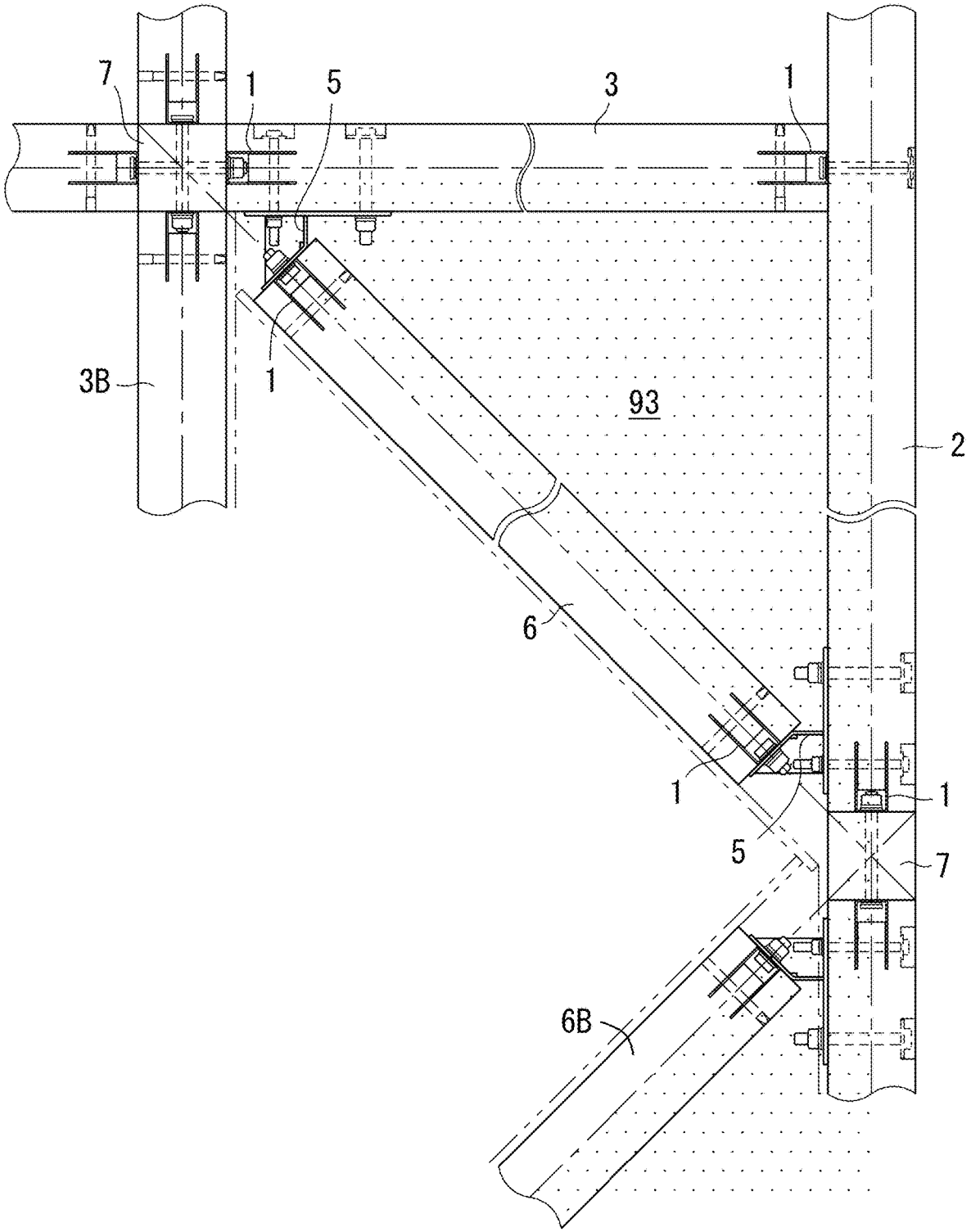
FIG. 5 is a front view illustrating a beam connecting structure in which a diagonal beam is bridged, using diagonal beam joining hardware, at an inner corner made by two beams orthogonally connected to each other.
Figure 6:
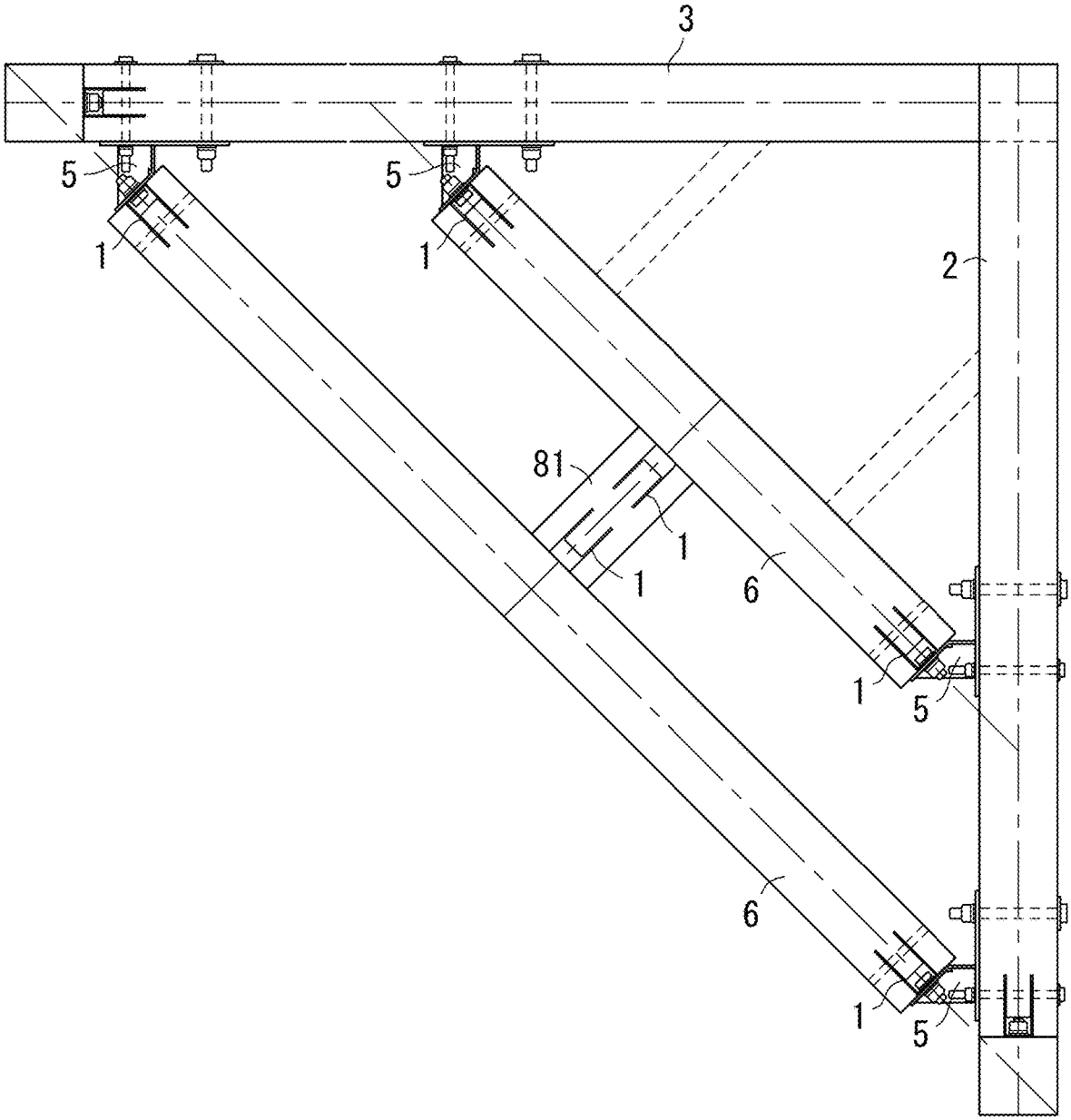
FIG. 6 is a front view illustrating a beam connecting structure in which two diagonal beams are bridged, using diagonal beam joining hardware, at an inner corner made by two beams orthogonally connected to each other.
Figure 7:
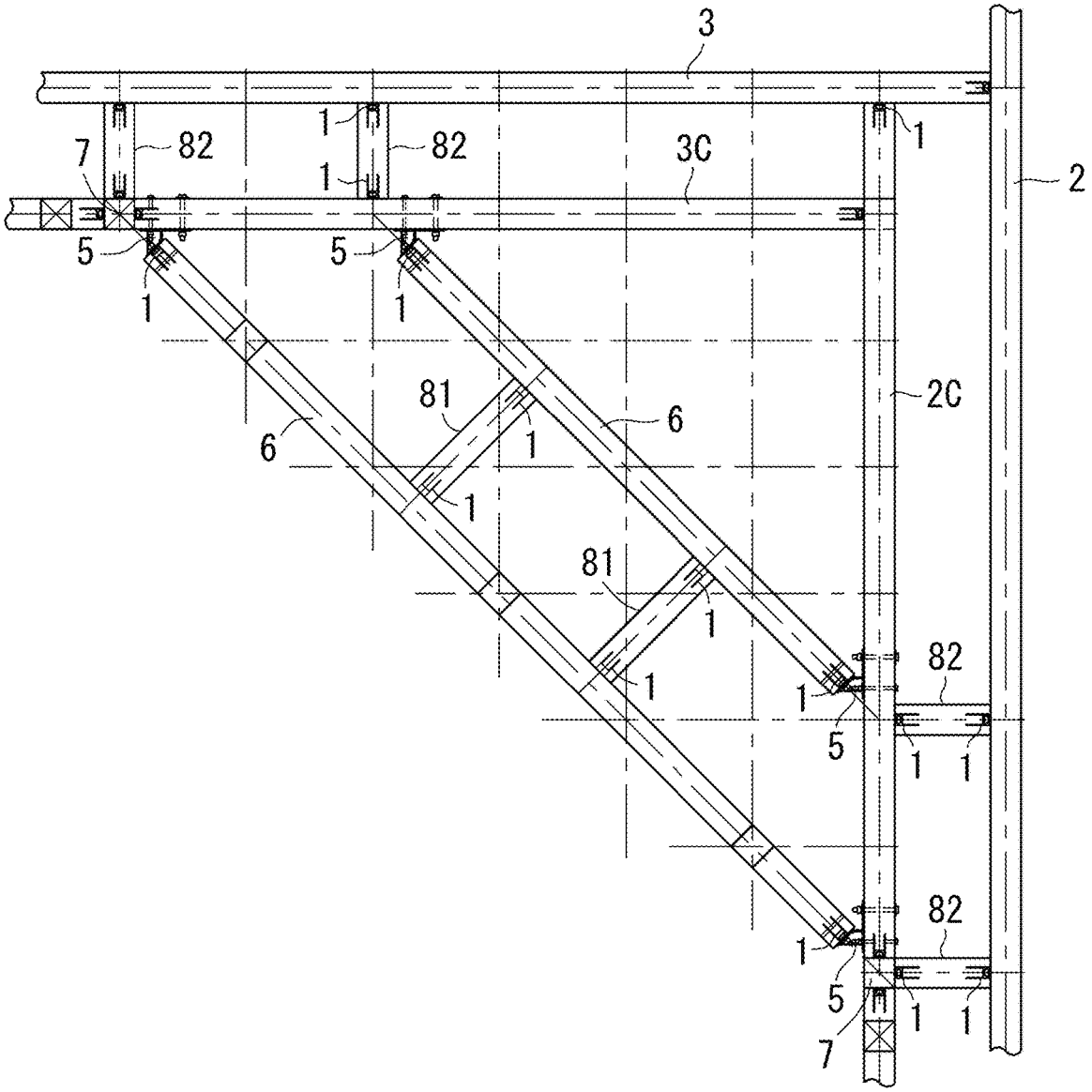
FIG. 7 is a front view illustrating a variation of a beam connecting structure such as the beam connecting structure shown in FIG. 6.
Figure 8A:
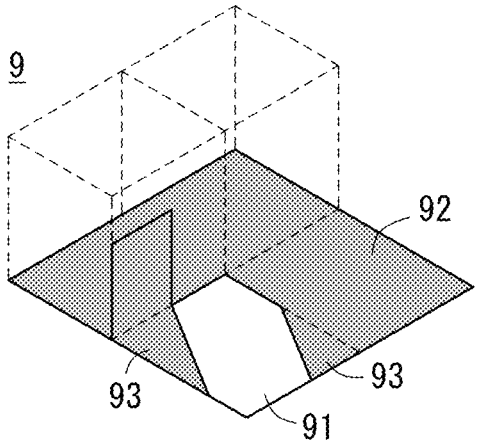
FIG. 8A, FIG. 8B and FIG. 8C are conceptual diagrams explaining images of spatial compositions where a floor surface having a triangle shape in plan view overhangs from a corner of a floor surface facing an atrium.
Figure 8B:
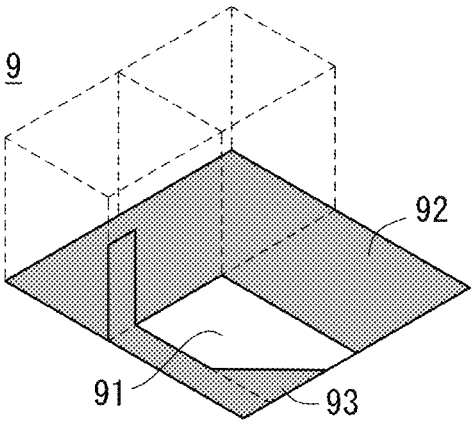
Figure 8C:
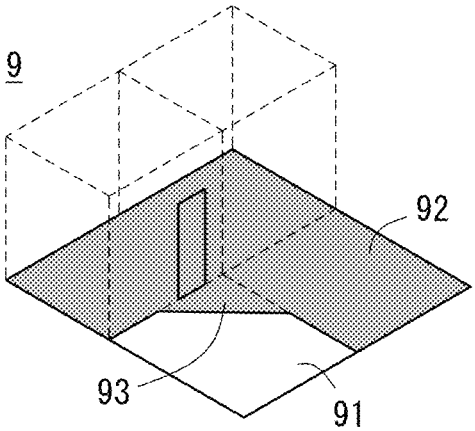

FIGS. 5 to 7 are front views illustrating a beam connecting structure in which the diagonal beam 6 is bridged using the diagonal beam joining hardware 5 at an inner corner made by two beams 2 and 3 orthogonally connected to each other.

The two beams 2 and 3 shown in FIG. 5 are girders that are arranged, for example, to be parallel to respective base lines of a wooden building for the purpose of supporting the horizontal diaphragm having a rectangular shape in plan view. The diagonal beam 6, which intersects with the beams 2 and 3 respectively at 45 degrees in plan view, is connected, as a discontinued beam, to the beams 2 and 3. Two pieces of the diagonal beam joining hardware 5, which connect one end part and the other end part of the diagonal beam 6 respectively to the beams 2 and 3, have the shapes bilaterally symmetrical to each other in plan view. In this connecting structure, the end parts of the diagonal beam 6 are respectively supported in the state of separating from the beams 2 and 3. Thus, even when a frame has a structure in which a pillar 7, another beam 3B, another diagonal beam 6B and the like are connected to the intersection points of the base lines as exemplarily shown in FIG. 5, it is possible to make the extension line of the axis of the diagonal beam 6 pass through the intersection points of the base lines without interfering with the above pillars and the beams. With this beam connecting structure, it is possible to provide a floor diaphragm in a rational manner so as to support the overhanging floor 93 having a triangular shape in plan view.

In the aspect shown in FIG. 6, two beams (girders) 2 and 3, which are arranged so as to be parallel to the respective base lines, are orthogonally connected to each other. At an inner corner made by the above two beams 2 and 3, two diagonal beams 6 and 6 are bridged so as to be parallel to each other at an interval of several dozen mm. Both end parts of the respective diagonal beams 6 and 6 are connected to the beams 2 and 3 by the pieces of beam receiving hardware 1 and the pieces of diagonal beam joining hardware 5. Furthermore, between the respective diagonal beams 6 and 6, a tie beam 81 is provided so as to be orthogonal to the respective diagonal beams 6 and 6 in plan view. Both end parts of the tie beam 81 are connected to respective side faces of the diagonal beams 6 and 6 by the pieces of beam receiving hardware 1. With this beam connecting structure, it is possible to extend the size of the floor diaphragm that supports the overhanging floor having a triangular shape in plan view. In this floor diaphragm, the respective beam depths of the inner and shorter diagonal beam 6 and the tie beam 81 can be smaller than the beam depth of the outer and longer diagonal beam 6.

In the aspect shown in FIG. 7, the beams (girders) 2 and 3, which are arranged so as to be parallel to the respective base lines, are orthogonally connected to each other. Also, diagonal beam supporting beams 2C and 3C are each provided on the corresponding side of the beams 2 and 3 at an interval of several dozen mm so as to be parallel to the beams 2 and 3. The diagonal beam supporting beams 2C and 3C are provided so as to connect the diagonal beams 6. The beams 2 and 3 are respectively connected to the diagonal beam supporting beam 2C and 3C via buttress beams 82 located at the plurality of positions on the base lines. The pieces of beam receiving hardware 1 are also used to connect both end parts of the respective buttress beams 82 to the beams 2 and 3, and to the diagonal beam supporting beams 2C and 3C.

The two diagonal beams 6 and 6 are bridged so as to be parallel to each other at an inner corner made by the two diagonal beam supporting beams 2C and 3C orthogonally connected to each other. Both end parts of the respective diagonal beams 6 and 6 are connected to the diagonal beam supporting beams 2C and 3C by the pieces of beam receiving hardware 1 and the pieces of diagonal beam joining hardware 5. Furthermore, between the respective diagonal beams 6 and 6, short tie beams 81 are provided so as to be orthogonal to the respective diagonal beams 6 and 6 in plan view. Both end parts of the tie beams 81 are connected to respective side faces of the diagonal beams 6 and 6 by the pieces of beam receiving hardware 1. With this beam connecting structure, it is possible to further extend the size and/or shape of the floor diaphragm that supports the overhanging floor having a triangular shape in plan view.

As described above, when the diagonal beam joining hardware in the invention of the present disclosure is used together with the conventional beam receiving hardware, it is possible to efficiently and economically connect the parts of the beams obliquely intersecting with each other with desirable strength. Furthermore, by this connecting structure, a diagonal beam can be bridged at an inner corner made by two beams orthogonally connected to each other such that the diagonal beam obliquely intersects with the two beams. Thus, it is possible to construct efficiently a support diaphragm for the overhanging floor having a triangular shape in plan view. Since the diagonal beam that supports a hypotenuse of the floor surface has a sufficient strength, it is also possible to place a railing or the like thereon.

Also, it is possible to change a joining angle of the diagonal beam without changing the beam receiving hardware by changing the plane angle of the beam receiving hardware mounting part with respect to the beam splicing part of the diagonal beam joining hardware. In this way, it is possible to rationally construct not only the floor surface having the shape of an isosceles triangle with the interior angles of 45° C. but also other triangular shaped floor surfaces with the interior angles of, for example, 30 degrees and 60 degrees.

The foregoing embodiment is to be considered in all respects as illustrative and not limiting. The technical scope of the invention is indicated by the appended claims rather than by the foregoing embodiment. At to the members not specifically identified in the scope of the appended claims, all modifications and changes may be appropriately made to the shape, material, size and number thereof, or the connecting state and relative positional relationship thereof when implementing the invention disclosed in the present application, provided that such modifications and changes are made within the range where the functions and effects are substantially equal to or greater than the above embodiments.

INDUSTRIAL APPLICABILITY

The invention of the present disclosure is suitably and widely used to a framework of a wooden building.

DESCRIPTION OF REFERENCE NUMERALS

1 Beam receiving hardware
12 Contacting part
13 Inserting part
14 Bolt receiving part
15 Through hole
2 Beam (continued beam)
22 Penetrating hole
23 Penetrating hole
24 Spot facing part
25 Spot facing part
3 Beam (discontinued beam)
31 Slit
42 Through bolt
43 Through bolt
44 Drift pin
45 Through bolt
46 Through bolt
47 Nut
48 Binding bolt
5 Diagonal beam joining hardware
51 Beam splicing part
52 Extending part
53 Beam receiving hardware mounting part
54 Reinforcing rib
55 Through hole
56 Through hole
57 Through hole
6 Diagonal beam
61 Slit
7 Pillar
81 Tie beam
82 Buttress beam
91 Atrium
92 Floor surface
93 Overhanging floor

The invention claimed is:

1. A beam connecting structure for joining at least one beam to a diagonal beam that obliquely intersects with the at least one beam in plan view using diagonal beam joining hardware such that the at least one beam is a continued beam with respect to the diagonal beam, wherein the diagonal beam joining hardware comprising a plurality of metal sheets formed together to comprise:

a first metal sheet of the plurality of metal sheets formed as a beam splicing part configured to be attached to a side face of the continued beam;

a second metal sheet of the plurality of metal sheets formed as an extending part protruding from an intermediate part of the beam splicing part in a width direction of the beam splicing part so as to make a T-shape together with the beam splicing part in plan view; and a third metal sheet of the plurality of metal sheets formed as a beam receiving hardware mounting part by bending so as to extend from an end edge of the extending part to form a plane angle with respect to the beam splicing part, wherein the beam splicing part is divided by the extending part into two areas each comprising a first plurality of through holes, and the beam receiving hardware mounting part includes a second plurality of through holes configured to be connected to beam receiving hardware comprising a bracket that is attached to an end part of the diagonal beam, the beam splicing part is attached and fastened to a side face of the at least one beam by a through bolt that penetrates the at least one beam in a beam width direction, the beam receiving hardware is fitted in a slit formed in the end part of the diagonal beam, the beam receiving hardware includes: a contacting part having two edge parts and a shape of a vertically elongated rectangle; and a pair of inserting parts protruding from the two edge parts of the contacting part at a right angle and being parallel to each other, and the contacting part of the beam receiving hardware is superimposed on the beam receiving hardware mounting part of the diagonal beam joining hardware and fastened to the beam receiving hardware mounting part by a bolt and a nut.

2. The beam connecting structure according to claim 1, wherein the diagonal beam is bridged at an inner corner made by two beams comprising the at least one beam and another beam orthogonally connected to each other such that the diagonal beam intersects with the two beams respectively at 45 degrees in plan view, and the diagonal beam includes a first end part and a second end part at longitudinal ends of the diagonal beam, and the first end part and the second end part of the diagonal beam are connected to a corresponding beam of the two beams by the beam receiving hardware and the diagonal beam joining hardware.

3. The beam connecting structure according to claim 2, wherein the diagonal beam comprises a plurality of diagonal beams that is bridged at the inner corner made by the two beams orthogonally connected to each other such that the plurality of diagonal beams is parallel to one another, each beam of the plurality of diagonal beams includes the first end part and the second end part at the longitudinal ends thereof, and the first end part and the second end part of each of the plurality of diagonal beams are connected to a corresponding beam of the two beams by the beam receiving hardware and the diagonal beam joining hardware, a tie beam is provided between two corresponding diagonal beams of the plurality of diagonal beams such that the tie beam is orthogonal to the two corresponding diagonal beams in plan view, and the tie beam includes end parts, and each end part of the tie beam is connected to a corresponding side face of the two corresponding diagonal beams by the beam receiving hardware.

* * * * *